United States Patent [19]

Topic et al.

[11] Patent Number: 4,829,872

[45] Date of Patent: May 16, 1989

[54] DETECTION OF MUSICAL GESTURES

[75] Inventors: Michael W. Topic, Marsfield; Wayne P. Connolly, Pyrmont, both of Australia

[73] Assignee: Fairlight Instruments Pty. Limited, Australia

[21] Appl. No.: 192,322

[22] Filed: May 10, 1988

[30] Foreign Application Priority Data

May 11, 1987 [AU] Australia ..... PI1841

[51] Int. Cl.[4] ..... G10G 1/00; G10F 5/00

[52] U.S. Cl. ..... 84/453; 84/1.01; 84/1.03

[58] Field of Search ..... 84/1.01, 1.03, 105, 84/453, 454, DIG. 18

[56] References Cited

U.S. PATENT DOCUMENTS

| | | | |
|---|---|---|---|
| 4,174,652 | 11/1979 | Campbell | 84/1.01 |
| 4,178,821 | 12/1979 | Gallina et al. | 84/1.01 |
| 4,193,332 | 3/1980 | Richardson | 84/1.01 |
| 4,265,157 | 5/1981 | Fricke et al. | 84/1.01 X |
| 4,280,387 | 7/1981 | Moog | 84/1.01 |
| 4,313,361 | 2/1982 | Deutsch | 84/1.01 |
| 4,429,609 | 2/1984 | Warrender | 84/454 |
| 4,463,650 | 8/1984 | Rupert | 84/1.01 X |
| 4,527,456 | 7/1985 | Perkins et al. | 84/1.03 X |
| 4,633,748 | 1/1987 | Takashima et al. | 84/1.01 |
| 4,771,671 | 9/1988 | Hoff, Jr. | 84/453 X |

*Primary Examiner*—W. B. Perkey

*Attorney, Agent, or Firm*—Davis, Bujold & Streck

[57] ABSTRACT

Musical information is analyzed in terms of pitch and/or amplitude to provide an output which is useful in controlling musical synthesizers but may have other applications also. By controlling music synthesizers, synthesized sounds may be played in synchronism with source music. Detection of musical gestures occurs in the present improved method, a musical gesture being the onset or cessation of individual notes comprising a musical performance or the like. The method comprises measuring at selected points in time the pitch and/or amplitude of the musical signal, calculating the change in pitch and amplitude at intervals, calculating the change of said changes in pitch and/or amplitude at intervals, comparing these change of changes to threshold values, and providing the change of changes in pitch and/or amplitude exceeds the threshold, generating a signal signifying the onset of the musical gesture.

18 Claims, 4 Drawing Sheets

DETECTION OF MUSICAL GESTURES

BACKGROUND OF THE INVENTION

The present invention relates to methods of, and devices for, analysing music as it is being played in real time. Such devices display musical information derived from such an analysis with the information being displayed on a screen or some other device, and/or produce electrical outputs corresponding to the pitch, amplitude or other characteristic of the music being analysed. Such data is normally used to control music synthesisers, with the objective of playing synthesised sounds in synchronism with source music. For example, music played on a trumpet may be fed into such a device, which in turn feeds a synthesiser producing a piano-like sound with the result that the music played by the trumpet player will be reproduced as a piano sound accompaniment.

Such devices suffer from a major problem in that they have difficulty detecting musical gestures such as the onset of successive notes. The term "musical gestures" as used herein means the onset, or cessation, of individual notes comprising a musical performance or events of similar musical significance, for example the plucking, striking, blowing, or bowing of a musical instrument.

Traditional methods of detecting musical gestures have been based either upon the amplitude of the gesture or upon the pitch of the gesture. The detection of musical gestures based upon their amplitude uses either an amplitude threshold detector or a peak detector, or a combination of the two.

The prior art method of using a threshold detector is as follows:

When the amplitude of an incoming audio signal exceeds a preset level, the trigger for the envelope of the synthetic tone is commenced. This prior art method has the disadvantage that, for almost all real musical tones which are used as input, the amplitude does not drop significantly between notes played in rapid succession. As a consequence, many of the new notes played into the device do not cause desired corresponding new envelopes to be commenced in the synthesised timbre.

With the prior art Peak detection means, use is made of the fact that many real musical input tones have a much greater level when a new note is played. One difficulty with this arrangement is that many musical instruments which can be used to originate the audio input, have amplitudes which rise very slowly when a new note is commenced. Such musical instruments include members of the string family where a bowing action is employed to articulate notes. Also, members of the brass and woodwind families can, when played by the instrumentalist according to certain techniques, exhibit slowly rising amplitudes. This makes it difficult to detect the peak quickly.

A further problem in this connection is that the synthetic envelope, which is commenced by the synthesiser, only begins to increase in amplitude after the peak of the input has been detected and thus the input's signal amplitude is decreased. Since the synthesiser is operating in real time, this means that the synthesiser is only starting a note when the input signal is decaying. This leads to an unacceptable delay between the envelope of the input signal and the envelope of the synthesised timbre, especially for musical inputs which take a very long time for their amplitudes to peak (for example a bowed cello).

Another problem with peak detection is that when a musical input consists of notes played in very rapid succession, the peaks are seldom much larger than the previous amplitude and hence, are difficult to detect and are easily missed.

Prior art methods of detecting musical gestures based upon pitch have always been relatively crude. In one prior art method, a new note commenced by the synthesiser (that is a new synthesised envelope) is commenced when the input pitch crosses some predefined boundary. This method is known as pitch quantisation. It has the effect of mapping all possible input pitches into a finite set of pitches (usually semitones) according to the member of the set to which the input pitch is closest. A substantial problem with this method is that if an input pitch is close to a boundary, any slight deviations of the input pitch can cross the boundary, thus generating new envelopes in the synthesised timbre where no real musical gesture existed in the input signal.

Furthermore, most musical inputs are capable of vibrato (that is a low frequency pitch modulation) and can cross several semitone boundaries. This leads to a glissando effect in the synthesised timbre because of the creation of envelopes in the synthesised timbre which have no matching counterpart in the input signal. While this may be potentially musically interesting, it is generally speaking an undesirable and unwanted side effect.

A further prior art method of detecting new notes based upon pitch, is to only generate a new envelope in the synthesised timbre when the Pitch detector has detected a pitched input signal as opposed to a pitchless or random input signal. The major disadvantage of this scheme is that two notes which are not separated by unpitched sounds, do not cause a new synthesised envelope to be generated. For musical inputs from musical instruments which have a long reverberant sustained characteristic (such as those instruments which incorporate a resonant cavity in their physical construction for the purpose of amplifying the acoustic output of the primary vibrating mechanism, (members of the string family are examples) notes are not separated by unpitched input and hence, some envelopes which ought to have been generated by the synthesiser are not generated.

In addition to detecting musical gestures, it is highly desirable that such synthesisers be able to detect the force with which a new note was played by a musician. The traditional prior art method of force detection is to record the peak amplitude or the amplitude at the time at which the synthetic envelope is commenced. This information is then used to determine the magnitude of the synthetic envelope. In the first case, information about the force of playing was not available until the amplitude had peaked which, in the case of inputs having an amplitude rising only slowly, leads to an unacceptably long delay before an envelope and timbre, suitably modified according to the force of playing information, could be commenced by the synthesiser.

In the second case where the amplitude value at the time a new note is detected is used as a representation of the playing force, the prior art method suffers from a lack of resolution in level and tends not to be correlated with playing force in a repeatable way. As a consequence, different amplitude levels can occur for the same playing force. In particular, there is no direct and unique identification of playing force from raw amplitude readings.

SUMMARY OF THE INVENTION

The present invention is directed to new and useful developments over the prior art which may provide improved methods of detecting musical gestures.

According to the present invention there is provided a method of determining the onset of a musical gesture comprising the steps of measuring at selected points in time the pitch and/or amplitude of a musical signal, calculating the change in pitch and amplitude between the measurements, calculating the change between successive ones of said changes in pitch and amplitude, comparing said change of changes to threshold values, and in the case that the change of changes in pitch and/or amplitude exceeds said threshold, generating a signal signifying the onset of the musical gesture.

In order to prevent erroneous signaling of musical gestures on the cessation of change of pitch or a quick succession of amplitude changes, due for example to noise, the method also provides for disabling the gesture detection process for a specified period equal to the smallest interval between gestures which can be realistically generated by a human performer.

A further useful and novel feature of the invention is the ability to provide as an output a signal indicative of the rate of amplitude change at the time of detection of a gesture. This signal can be used as an indication of the strength of attack of the gesture, for example, how hard a guitar string has been plucked, and is referred to hereinafter as the "playing force". The playing force can be used with good result as a control parameter for a music synthesiser being triggered by musical gestures detected by the invention.

DESCRIPTION OF THE DRAWINGS

A preferred embodiment of the invention will now be described with reference to the drawings in which.

Table 1 is a list of suitable component types for the preferred embodiment; and Listing 1 is a programme listing of the gesture-detection algorithms used by the microprocessor of the preferred embodiment.

DESCRIPTION OF THE PREFERRED EMBODIMENT

Figure 1:
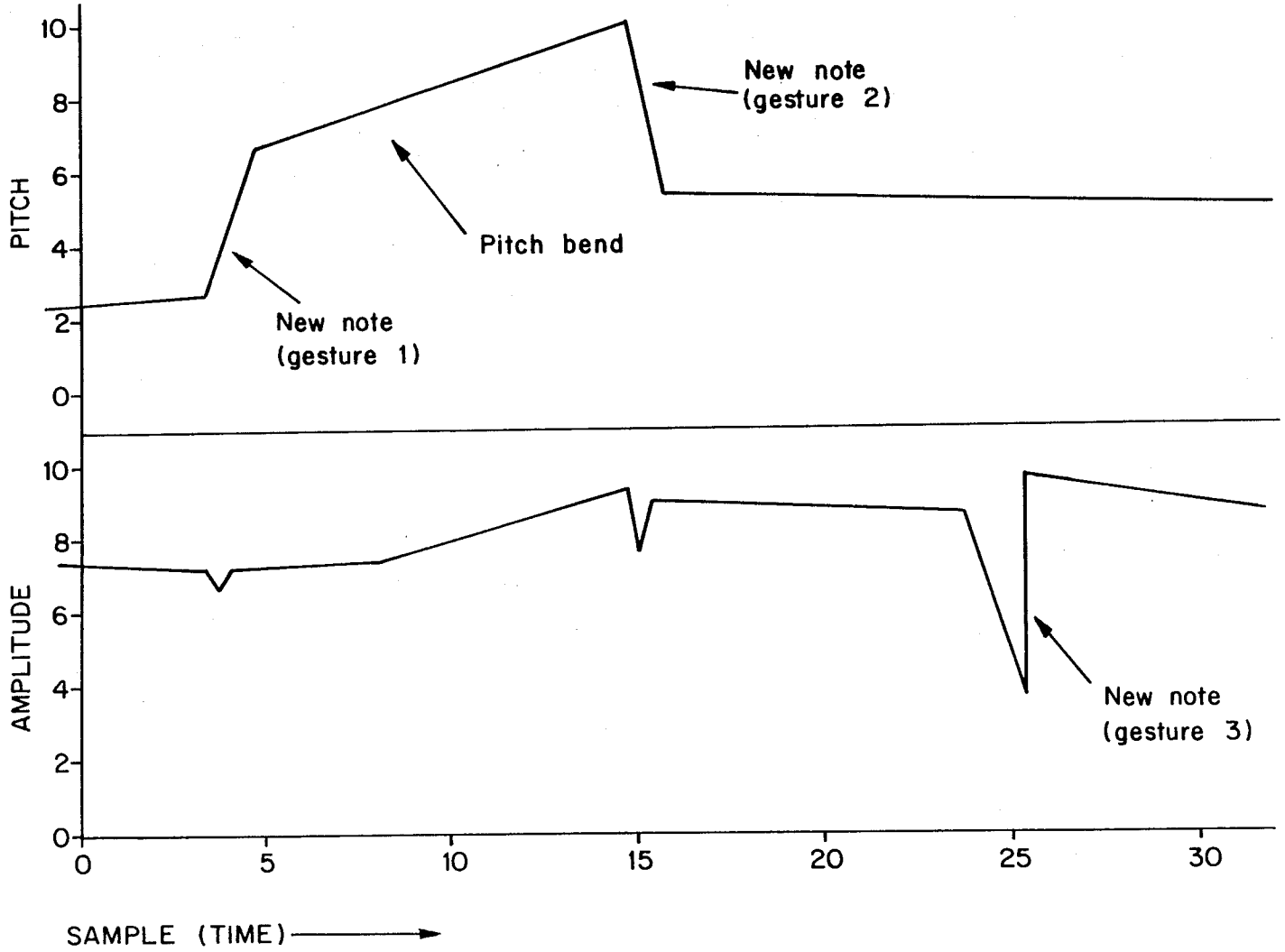
FIG. 1 is a graphic representation of an example of musical signal featuring musical gestures to be detected.

Referring now to FIG. 1, an example of a musical signal input can be seen, wherein the signal is represented as pitch as a function of time and amplitude as a function of time. The amplitude and pitch axes are labelled in arbitrary units, and only relative values are significant. The horizontal time axis is shown as "sample" time units, which refers to a regular clock period; at the expiration of each clock period the pitch and amplitude signals are sampled by the calculators of the preferred embodiment of the invention. In practice, this clock must be of sufficiently high frequency to ensure fast response to changes of pitch or amplitude. A frequency of 1000 Hz is suitable for typical applications. The timescale of FIG. 1 has been expanded greatly for clarity of this example, showing three musical gestures within 30 sample periods. In reality, this would take place more reasonably over say 3000 samples.

As can be seen from FIG. 1, the three musical gestures shown are:

(1) Rapid increase in pitch with small change of amplitude (2) Rapid decrease in pitch with small change of amplitude (3) Momentary large reduction of amplitude with little change of pitch.

Note that between the first and second gestures, a significant change of pitch occurs, but this is a relatively slow change, representing a pitch bend rather than a gesture to be detected.

Figure 2:
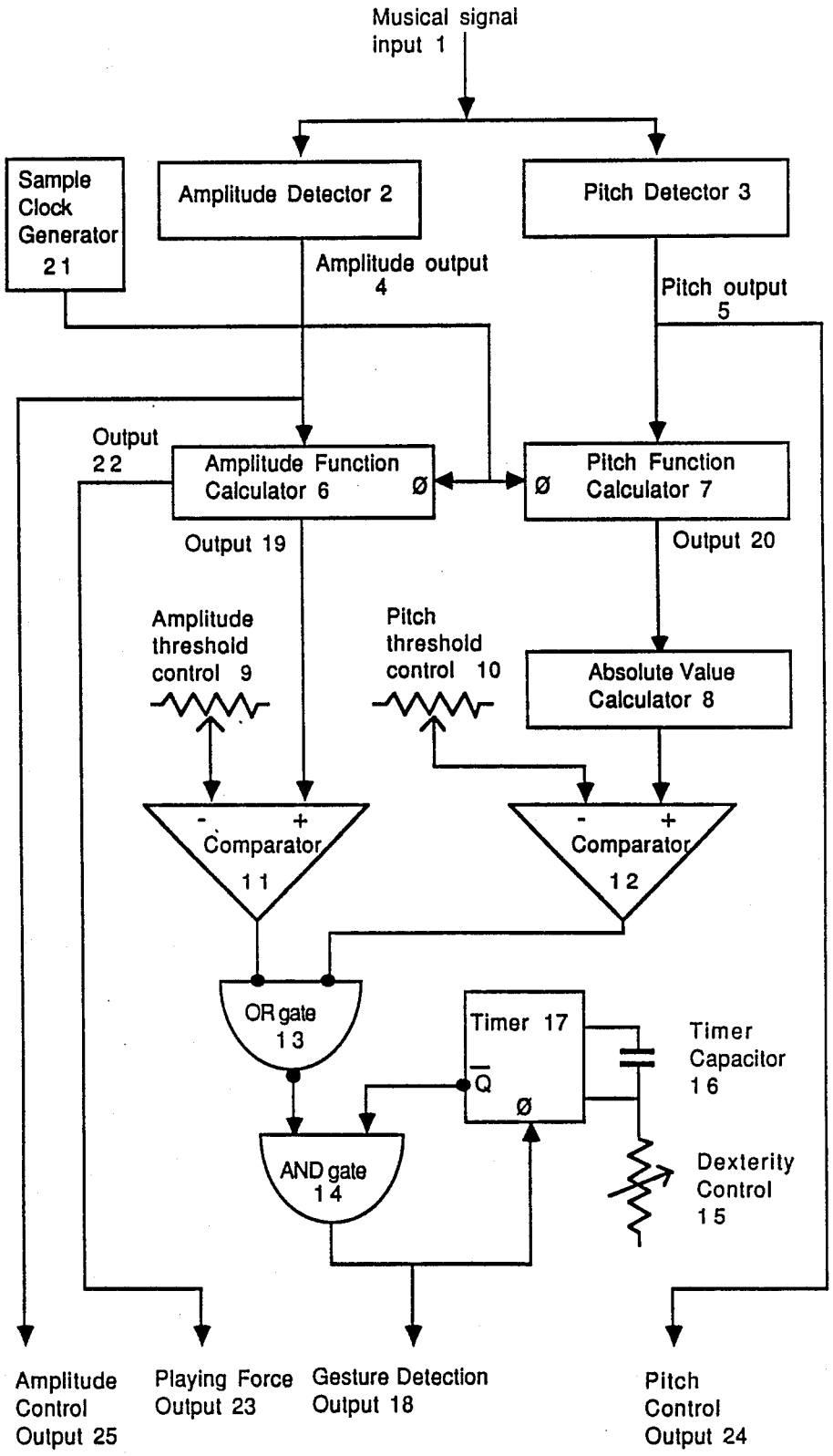
FIG. 2 is a block diagram of a practical embodiment of the invention.

Referring now to FIG. 2, a block diagram of a practical embodiment is seen. The components shown in this diagram can be implemented as discrete hardware, either analogue or digital, as functions of a suitably-programmed microprocessor, or any combination of these. Amplitude detector 2 comprises an envelope-follower circuit, well known to the audio art, which will be described in detail in reference to FIG. 3 below. Pitch detector 3 is implemented using a microprocessor (not shown) executing suitable software. For the purpose of this embodiment, the pitch detection technique described by Warrender in U.S. Pat. No. 4,429,609 is used with good results.

Sample Clock Generator 21 generates a clock signal at 1000 Hz which is fed to the interrupt input of the microprocessor for use as a timebase for all time-dependent functions. Although all other blocks of FIG. 2 are shown as distinct items of hardware, these are in fact implemented as software executed by the microprocessor of this embodiment of the invention. For the purposes of explanation, however, the functions of FIG. 2 will now be described.

Musical signal input 1 is fed to Amplitude Detector 2 and Pitch Detector 3. The outputs of Amplitude Detector 2 and Pitch Detector 3 are fed to Amplitude Function calculator 6 and Pitch Function Calculator 7 respectively. These calculators are clocked by Sample Clock Generator 21 at a rate of 1000 Hz, with the result that a calculation is executed each millisecond. The details of these calculations will be described in detail in reference to FIG. 3 below. Output 19 represents the rate of change of amplitude differences from sample to sample. Output 20 represents the rate of change of pitch differences from sample to sample. Output 19 feeds one input of Comparator 11, the other input oof which is fed a reference level from Amplitude Threshold Control 9. When Output 19 exceeds the established threshold, an output is generated from comparator 11, corresponding to a sufficiently large instantaneous positive rate of change of amplitude differences caused by a musical gesture, such as the third gesture shown in FIG. 1. Output 20 feeds the input of Absolute Value Calculator 8, which generates a positive signal of magnitude corresponding to its input without reference to sign. Absolute Value Calculator 8 is provided so that both upward and downward changes of pitch are recognised as gestures. The output of Absolute Value Calculator 8 feeds one input of Comparator 12, the other input of which is fed a reference level from Pitch Threshold Control 10. When the absolute value of Output 20 exceeds the established threshold, an output is generated from comparator 12, corresponding to a sufficiently large instantaneous rate of change of pitch differences caused by a musical gesture, such as the first or second gesture shown in FIG. 1.

The outputs of Comparator 11 and Comparator 12 are logically ORed by OR gate 13, the output of which corresponds to detection of gestures based on pitch or amplitude. In order to prevent a new gesture being signalled at the end of rapid pitch changes, as well as at the beginning, a response-limiting facility is provided to limit the response to repeated comparator outputs to a rate similar to that dictated by the dexterity of a human performer. The "dexterity" of the gesture detector is limited by AND gate 14 which, under control of Timer 17, momentarily disables the output of OR gate 13, upon detection of a first gesture, the disabling period being determined by the time constant of Dexterity Control 15 and Timer Capacitor 16. Gesture Detection Output 18 therefore represents the final desired gestures.

Some other outputs are provided by this embodiment of the invention, and although useful in many applications, for example for control of a music synthesiser, these are not essential to the novelty of the invention. Amplitude Output 4 from amplitude detector 2 represents the instantaneous amplitude of the input signal, and is provided for control of other devices as Amplitude Control Output 25. Output 22, from Amplitude Function Calculator 6, represents the amplitude difference from sample to sample, and is used as the Playing Force Output 23. Pitch Output 5 from Pitch Detector 3 can also be presented to external devices as a Pitch Control Output 24, suitable for instance as pitch control for a music synthesiser.

This embodiment will now be described in detail with reference to FIGS. 3 and 4, which shows a detailed schematic of a microprocessor-based realisation of the invention, and table 1 which lists suitable component types for this embodiment.

Figure 3:
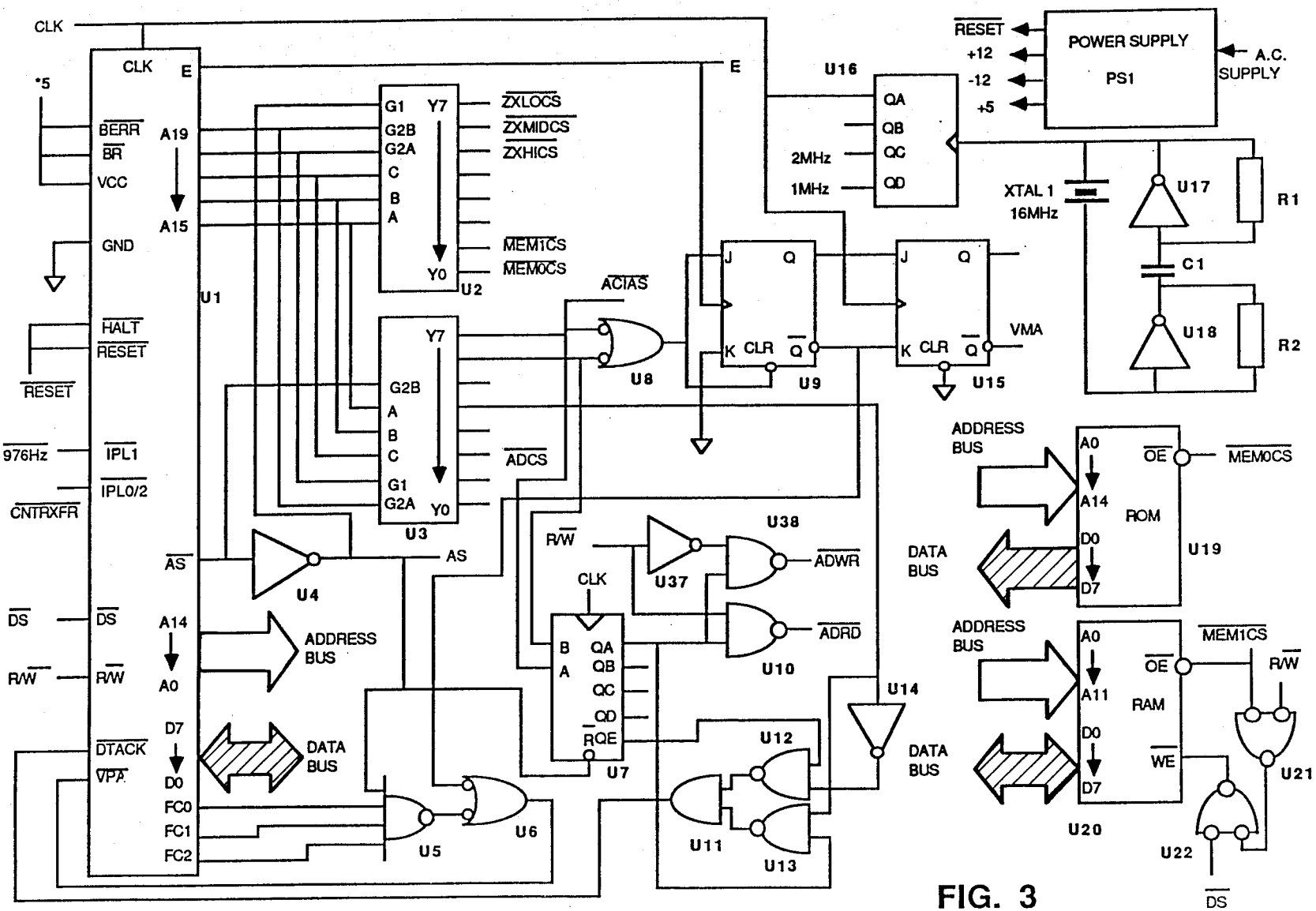
FIGS. 3–4 are a detailed schematic of a preferred embodiment of the invention.

As seen in FIG. 3, U1 is a microprocessor, Motorola type 68008. U1 performs all control and calculation functions of this embodiment, executing programme stored in read-only memory U19. The section of programme responsible for musical gesture determination can be seen in source-code form in Listing 1. The remainder of the programme, with the exception of the pitch determination routine, comprises input/output and control routines well known to those skilled in the computer art and are not shown. The pitch determination software may be any of the many types known to the art which use as input the interval between zero-crossings. One suitable technique is described by Warrender in U.S. Pat. No. 4,429,609.

Selectors U2 and U3 provide memory address decoding for all memory-mapped devices. U5, U6, U7, U11, U12, U13, U14 generate timing signals (VPA and DTACK) required by the 68008 microprocessor when accessing non-68000 compatible peripherals. U8, U9, U15 generate the VMA signal required by the ACIA (U29 of FIG. 4). U10, U37 and U38 generate read and write strobes for ADC (U36, FIG. 4). U17 and U18, with crystal XTAL1 and associated components, form a 16 Mhz master oscillator, which is divided down by counter U16 to provide a clock of 8 Mhz to the microprocessor U1, as well as 2 Mhz and 1 Mhz clocks for other timing purposes.

Power Supply PS1 is a conventional mains-powered DC supply, providing regulated power at +5 volts for all logic circuitry and +12, −12 volts for analogue circuitry such as op-amps. The power supply also generates a reset signal for the microprocessor, being a TTL level signal which remains low until after all supplies have stabilised at the correct operating voltages after power-on.

Figure 4:
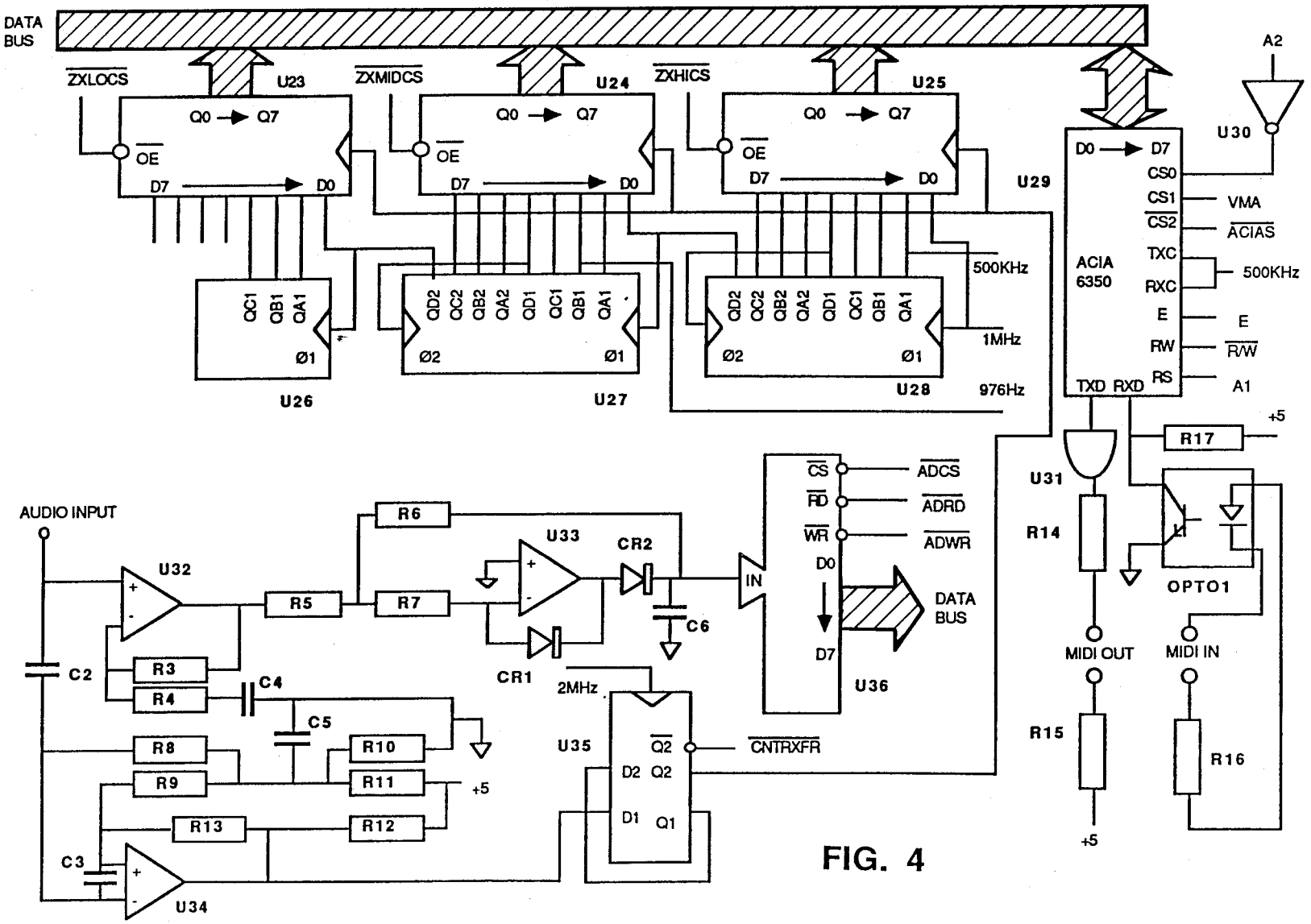

Referring now to FIG. 4, the Audio Input from which gestures are to be detected is fed to two separate paths, U32 being the first stage of the amplitude detector and U34 being the first stage of the pitch detector. Op-amp U32, along with R3, R4 and C4 form an amplifier with gain of 10. The amplified signal feeds a peak detector comprising op-amp U33, resistors R5, R6, R7, and diodes CR1 and CR2. Capacitor C6 along with the input impedance of ADC U36 provides a time constant sufficient to remove the individual cycles of audio frequencies, presenting a smoothed amplitude signal to the ADC U36. U36 is a National Semiconductor type ADC0820 ADC, which incorporates a track-and-hold circuit. A microprocessor write cycle addressing the ADC initiates a conversion cycle. The digital output of U36 is connected to the data bus so that the amplitude can be read by the microprocessor a few microseconds after the write cycle. U34 is a comparator, biased by resistors R8, R9, R10 and R11 so that the output changes state as the input audio signal passes through zero. Resistor R13 provides a small amount of positive feedback so that the comparator provides stable performance at its threshold point. Capacitor C3 further improves stability. Flip-flop U35 synchronises the output of the zero-crossing detector with the system clock. The synchronised zero-crossing signal is used to clock latches U23, U24 and U25. When such clocking occurs, the value of counters U26, U27 and U28 are latched and can be read by the microprocessor via its data bus. The counters are clocked by a 1 Mhz system clock, so the value read will correspond to elapsed time in microseconds. A 20-bit count is available from the three latches, being read in three operations by the microprocessor as the data bus is only 8-bits wide. Each zero crossing causes the microprocessor to be interrupted by the CNTRXFR output of U35. By subtracting the previous timer count from the current count, the interval between zero-crossings can be calculated at each interrupt. Microprocessor U1 also receives regular interrupts, approximately once every 1 millisecond (corresponding to a clock frequency of 976 Hz), from counter U27. These interrupts define the sample period used for calculation of amplitude and pitch functions. The inputs required by the function calculating routines, namely the instantaneous pitch value and amplitude value, are sampled at each sample period. The functions required are:

Instantaneous rate of change of pitch differences and

Instantaneous rate of change of amplitude differences where "difference" refers to change from one sample period to the next. Given that the sample period is constant, the rate of change of differences is calculated as follows:

$$f(V)=(V_0V_{-1})-(V_{-1}-V_{-2})$$

that is, $$f(V)=V_0-2V_{-1}+V_{-2}$$

where f(V) is the function of value V (pitch or amplitude)

$V_0$ is the current value $V_{-1}$ is the value one sample period earlier $V_{-2}$ is the value two sample periods earlier According to this algorithm, the outputs of the pitch and amplitude function generators, f(p) and f(a) respectively, corresponding to the musical input of the example of FIG. 1 can be tabulated as follows:

| Sample | Pitch (p) | Amplitude (a) | f (p) | f (a) | Gesture? |
|---|---|---|---|---|---|
| 1 | 2 | 7 | Invalid | Invalid | |
| 2 | 2 | 7 | Invalid | Invalid | |
| 3 | 2 | 7 | 0 | 0 | |
| 4 | 4 | 7 | 2 | 0 | Yes |
| 5 | 6 | 7 | 0 | 0 | |
| 6 | 7 | 7 | −1 | 0 | |
| 7 | 7 | 7 | −1 | 0 | |
| 8 | 7 | 7 | 0 | 0 | |
| 9 | 8 | 7 | 1 | 0 | |
| 10 | 8 | 8 | −1 | 1 | |
| 11 | 8 | 8 | 0 | −1 | |
| 12 | 9 | 8 | 1 | 0 | |
| 13 | 9 | 8 | −1 | 0 | |
| 14 | 9 | 9 | 0 | 1 | |
| 15 | 9 | 7 | 0 | −3 | |
| 16 | 5 | 9 | −4 | 4 | Yes |
| 17 | 5 | 9 | 4 | −2 | * |
| 18 | 5 | 8 | 0 | −1 | |
| 19 | 5 | 8 | 0 | 1 | |
| 20 | 5 | 8 | 0 | 0 | |
| 21 | 5 | 8 | 0 | 0 | |
| 22 | 5 | 8 | 0 | 0 | |
| 23 | 5 | 8 | 0 | 0 | |
| 24 | 5 | 7 | 0 | −1 | |
| 25 | 5 | 4 | 0 | −2 | |
| 26 | 5 | 9 | 0 | 8 | Yes |
| 27 | 5 | 9 | 0 | −5 | |
| 28 | 5 | 9 | 0 | 0 | |
| 29 | 5 | 9 | 0 | 0 | |
| 30 | 5 | 8 | 0 | −1 | |

*Invalid output, removed by dexterity timer gating.

Assuming thresholds for pitch and amplitude rate of change comparators are set to 2 units in this example, gestures will be detected at samples 4, 16 and 26. Note that an absolute value function is applied to pitch function calculations, so that negative values of greater magnitude than the selected threshold will cause a gesture output to be generated. The invalid output at sample 17 results from the sudden change of pitch differences at the cessation of gesture 2, and is eliminated from the final gesture output by dexterity timer windowing. In this embodiment this function is provided by software which upon signalling of a first gesture, disables further gesture signalling until a user-defined interval has elapsed. This technique effectively removes the unwanted spurious gesture without degrading response time to the wanted gesture.

When a gesture is detected, an output signal is generated via the asynchronous serial communications interface (U29, FIG. 4). The serial output is converted to current-loop levels by U31, to conform with the requirements of the MIDI (Musical Instrument Digital Interface) standard. The signal presented at the MIDI output is formatted to convey information including note start (gesture detected), playing force and pitch. A MIDI input is also provided as a convenient means of receiving user control input, such as setting of thresholds for the gesture detection algorithm. The MIDI input is optically isolated by OPTO1, in compliance with the MIDI standard.

TABLE 1

| DESIGNATION | DESCRIPTION | DESIGNATION | DESCRIPTION |
|---|---|---|---|
| U1 | 68008 Microprocessor | R1 | Resistor 560 ohm |
| U2 | 74HC138 1 of 8 selector | R2 | Resistor 560 ohm |
| U3 | 74HC138 1 of 8 selector | R3 | Resistor 330k ohm |
| U4 | 74HC14 invertor | R4 | Resistor 33k ohm |
| U5 | 74HC20 NAND gate | R5 | Resistor 20k ohm |
| U6 | 74HC00 NAND gate | R6 | Resistor 10k ohm |
| U7 | 74HC164 shift register | R7 | Resistor 20k ohm |
| U8 | 74HC00 NAND gate | R8 | Resistor 33k ohm |
| U9 | 74HC73 J-K flip flop | R9 | Resistor 1k ohm |
| U10 | 74HC00 NAND gate | R10 | Resistor 1k ohm |
| U11 | 74HC08 AND gate | R11 | Resistor 1k ohm |
| U12 | 74HC00 NAND gate | R12 | Resistor 10k ohm |
| U13 | 74HC00 NAND gate | R13 | Resistor 470k ohm |
| U14 | 74HC14 invertor | R14 | Resistor 220 ohm |
| U15 | 74HC73 J-K flip flop | R15 | Resistor 220 ohm |
| U16 | 74HC161 counter | R16 | Resistor 220 ohm |
| U17 | 74S04 inverter | R17 | Resistor 2200 ohm |
| U18 | 74S04 inverter | C1 | Capacitor 100 nF |
| U19 | 32k × 8 ROM | C2 | Capacitor 220 nF |
| U20 | 4k × 8 static RAM | C3 | Capacitor 100 pF |
| U21 | 74HC32 OR gate | C4 | Capacitor 220 nF |
| U22 | 74HC32 OR gate | C5 | Capacitor 10 uF |
| U23 | 74HC374 octal latch | C6 | Capacitor 100 nF |
| U24 | 74HC374 octal latch | CR1 | Diode 1N4148 |
| U24 | 74HC374 octal latch | CR2 | Diode 1N4148 |
| U26 | 74HC393 dual 4-bit counter | OPTO1 | Opto-isolator PC900 |
| U27 | 74HC393 dual 4-bit counter | XTAL1 | Crystal 16 Mhz |
| U28 | 74HC393 dual 4-bit counter | PS1 | Regulated power supply |
| U29 | 6350 ACIA | | |
| U30 | 74HC04 invertor | | |
| U31 | 74HC08 AND gate | | |
| U32 | TL084 op-amp | | |
| U33 | TL084 op-amp | | |
| U34 | LM339 comparator | | |
| U35 | 74HC175 4-bit D-flip flop | | |
| U36 | ADC0820 8-bit ADC | | |
| U37 | 74HC04 invertor | | |
| U38 | 74HC00 NAND gate | | |

LISTING

ADopt

This routine allows the VT5 to trigger from rapid positive changes in amplitude It uses data from the A/D conversion routine as its input and signals to MIDI via a flag. It writes the current amplitude at the time of the event to KEYVEL which is the MIDI key velocity sent.

```
ADOPT    btst    #0,SLEWFLG(a2)          Has this option been selected?
         beq     ADOPTX                  If not, exit
         btst    #4,MODER4+1(a2)         Is the semitone mode on?
         beq     ADOPTX                  If yes, exit
         tst.w   PITCH(a2)               Is the pitch in the window
         ble     ADOPTX                  If not exit
         jsr     GATECHK                 Check hardware gate . . .
         btst    #6,FLMSGN(a2)           . . .
         beq.s   ADOPT1                  Branch if gate is on
         clr.w   GATE(a2)                Clear software gate
         bra     ADOPTX                  Exit
ADOPT1   tst.w   GATE(a2)                Test software gate
         beq     ADOPTX                  Exit if it is off
         tst.b   ONTIMER(a2)             Is event detection inhibited?
         bne     ADOPTX1                 Branch if it is
         btst    #1,SLEWFLG(a2)          Has there been a new note in last 10 ms
         bne     ADOPTX3                 Branch and clear flag and set dexterity
.
.
.
         move.w  ADCVAL(a2),d0           Get the current ampl
         move.w  ADCOLD1(a2),d1          Get the last ampl
         move.w  ADCOLD2(a2),d2          Get the ampl before last
         move.w  d0,ADCOLD1(a2)          Store current ampl for next iteration
         move.w  d1,ADCOLD2(a2)          Save last ampl as well
         tst.b   ADCNTR(a2)              Have we collected three samples
         bne.s   ADOPTX2                 If not exit and decrement counter
         lsl.w   #1,d1                   Multiply last ampl by two
         sub.w   d1,d0                   Sub 2xlast ampl from current ampl
         add.w   d2,d0                   Add in ampl before last
         move.w  d0,DUMMY0(a2) Save temporarily
ADOPT2   blt     IMUXAX                  Branch if negative
         clr.w   d1
         move.b  ATKSENS(a2),d1          Fetch threshold
         cmp.w   d1,d0                   Compare current with threshold
         blt     IMUXAX                  If less than exit
.
.
.
         move.w  ADCVAL(a2),d0           Make sure this is an attach and . . .
         sub.w   d2,d0                   . . . not a decay
         blt     IMUXAX                  If decay exit
         bset    #4,SLEWFG(a2)           Set flag for MIDI routine
         bsr     MIDI0
         move.b  DEXTRTY(a2),ONTIMER(a2) Reset dexterity counter
         move.b  #2,ADCNTR(a2)           Reset sample counter
         bra.s   IMUXAX
.
.
.
ADOPTX1  subi.b  #10,ONTIMER(a2)         Decrement dexterity counter
ADOPTX   move.b  #2,ADCNTR(a2)           Reset sample counter
         bra.s   IMUXAX
ADOPTX2  subi.b  #1,ADCNTR(a2)           Decrement sample counter
bra.s    IMUXAX
ADOPTX3  move.b  DEXTRTY(a2),ONTIMER(a2) Reset dexterity counter for ADOPT
         bclr    #1,SLEWG(a2)            Reset new note flag
         move.b  #2,ADCNTR(a2)           Reset sample counter for ADOPT
         move.b  DEXTRTY(a2),ONTIMER1(a2) Reset counter for PCDOPT
         move.b  #2,SAMPCNTR(a2)         Reset sample counter for PCDOPT
IMUXAX   bra     TBIRQX
```

PCDOpt

This routine allows the VT5 to trigger from rapid changes in valid pitch. It uses outputs from the main pitch determination algorithm as its inputs and signals to MIDI via a flag. It writes the current amplitude at the time of the event to KEYVEL which is the MIDI key velocity sent.

```
PCDOPT   btst    #5,SLEWFLG(a2)          Has this option been selected?
         beq     PCDOPTX                 If not, exit
         btst    #4,MODER4+1(a2)         Is the semitone mode on?
         beq     PCDOPTX                 If yes, exit
         tst.w   PITCH(a2)               Is the pitch in the window
         ble     PCDOPTX                 If not exit
         jsr     GATECHK                 Check hardware gate . . .
         btst    #6,FLMSGN(a2)           . . .
```

-continued

LISTING

```
          beq.s    PCDOPT1                  Branch if gate is on
          clr.w    GATE(a2)                 Clear software gate
          bra      PCDOPTX                  Exit
PCDOPT1   tst.w    GATE(a2)                 Test software gate
          beq      PCDOPTX                  Exit if it is off
          tst.b    ONTIMER1(a2)             Is event detection inhibited?
          bne      PCDOPTX1                 Branch if it is
          btst     #1,SLEWFLG(a2)           Has there been a new note in last 10 ms
          bne      PCDOPTX3                 Branch and clear flag and set dexterity
.
.
.
          move.w   PITCH(a2),d0             Get the current pitch
          move.w   PPITCH(a2),d1            Get the last pitch
          move.w   PPITCH1(a2),d2           Get the pitch before last
          move.w   d0,PPITCH(a2)            Store current pitch for next iteration
          move.w   d1,PPITCH1(a2)           Save last pitch as well
          tst.b    SAMPCNTR(a2)             Have we collected three samples
          bne.s    PCDOPTX2                 If not exit and decrement counter
          lsl.w    #1,d1                    Multiply last pitch by two
          sub.w    d1,d0                    Sub 2xlast pitch from current pitch
          add.w    d2,d0                    Add in pitch before last
          bge.s    PCDOPT2                  Branch if positive
          neg.w    d0                       Negate result to make it positive
PCDOPT2   cmp.w    INTVSNS(a2),d0           Compare current with threshold
          blt      IMUXDX                   If less than exit
.
.
.
          bset     #4,SLEWFLG(a2)           Set flag for MIDI routine
          bsr      MIDI0
          andi.b   #%11111101,PCDFLG(a2)    Clear flags
          move.b   DEXTRTY(a2),ONTIMER1(a2) Reset dexterity counter
          move.b   #2,SAMPCNTR(a2)          Reset sample counter
          bra.s    IMUXDX
.
.
.
PCDOPTX1  subi.b   #10,ONTIMER1(a2)         Decrement dexterity counter
PCDOPTX   move.b   #2,SAMPCNTR(a2)          Reset sample counter
          bra.s    IMUXDX
PCDOPTX2  subi.b   #1,SAMPCNTR(a2)          Decrement sample counter
          bra.s    IMUXDX
PCDOPTX3  bclr     #1,SLEWFLG(a2)           Reset new note flag
          move.b   DEXTRTY(a2),ONTIMER1(a2) Reset counter for PCDOPT
          move.b   #2,SAMPCNTR(a2)          Reset sample counter for PCDOPT
          move.b   DEXTRTY(a2),ONTIMER(a2)  Reset counter for ADOPT
          move.b   #2,ADCNTR(a2)            Reset sample counter for ADOPT
```

What we claim is:

1. A method of determining the onset of a musical gesture comprising the steps of measuring at selected points in time the pitch of a musical signal, calculating the change in pitch between the measurements, calculating the change between successive ones of said changes in pitch, comparing said change of changes to threshold values and in the case that the change of changes in pitch exceeds said threshold generating a signal signifying the onset of the musical gesture.

2. A method as claimed in claim 1 including the step of disabling the gesture detection process for a specified period equal to the smallest interval between gestures which can be realistically generated by a human performer.

3. A method as claimed in claim 1 including the step of filtering the musical signal so as to remove frequencies outside a selected frequency range.

4. A method as claimed in claim 3 including the steps of measuring at selected points in time the amplitude of a musical signal calculating the change in amplitude between the measurements calculating the change between successive ones of said changes in amplitude, comparing said change of changes to threshold values and in the case that the change of changes in amplitude exceeds said threshold generating a signal signifying the onset of the musical gesture.

5. A method of determining the onset of a musical gesture comprising the steps of measuring at selected points in time the pitch of a musical signal, calculating the change in pitch between the measurements, calculating the change between successive ones of said changes in pitch, comparing said change of changes to threshold values and in the case that the change of changes in pitch exceeds said threshold generating a signal signifying the onset of the musical gesture, the method including the steps of measuring at selected points in time the amplitude of a musical signal calculating the change in amplitude between the measurements calculating the change between successive ones of said changes in amplitude, comparing said change of changes to threshold values and in the case that the change of changes in amplitude exceeds said threshold generating a signal signifying the onset of the musical gesture.

6. A method of determining the onset of a musical gesture comprising the steps of measuring at selected points in time the amplitude of a musical signal, calculating the change in amplitude between the measurements, calculating the change between successive ones of said changes in amplitude comparing said change of changes to threshold values and in the case that the change of changes in amplitude exceeds said threshold generating a signal signifying the onset of the musical gesture.

7. A method as claimed in claim 6 including the step of disabling the gesture detection process for a specified period equal to the smallest interval between gestures which can be realistically generated by a human performer.

8. A method as claimed in claim 6 including the step of providing an output signal indicative of the rate of amplitude change at the time of detection of a gesture.

9. A method as claimed in claim 8 including the step of filtering the musical signal to remove frequencies outside a selected frequency range.

10. A method of determining the onset of a musical gesture comprising the steps of measuring at selected points in time the amplitude of a musical signal, calculating the change in amplitude between the measurements, calculating the change between successive ones of said changes in amplitude comparing said change of changes to threshold values and in the case that the change of changes in amplitude exceeds said threshold generating a signal signifying the onset of the musical gesture, including the step of filtering the musical signal to remove frequencies outside a selected frequency range.

11. A detector for detecting the onset of a musical gesture comprising a pitch detector for measuring at selected points in time the pitch of a musical signal, the pitch detector being arranged to be connected to a means for calculating the change in pitch between the measurements and calculating the change between successive ones of said changes in the pitch and comprising a comparator arranged to compare said change of changes to threshold values and to generate a signal signifying the onset of the musical gesture when the change of changes in the pitch exceeds the threshold values.

12. A detector as claimed in claim 11 comprising a disabling means for disabling the gesture detection process for a specified period equal to the smallest interval between gestures which can be realistically generated by a human performer.

13. A detector as claimed in claim 11 comprising a filter which is arranged to filter the musical signal and remove frequencies outside a selected frequency range.

14. A detector as claimed in claim 13 comprising an amplitude detector for measuring at selected points in time the amplitude of a musical signal and the amplitude detector having an output connected to a means for calculating the change in amplitude between the measurements and calculating the change between successive ones of said changes in the amplitude and comprising a comparator arranged to compare said change of changes in amplitude and to generate a signal signifying the onset of the musical gesture when the change of changes in amplitude exceeds the threshold values.

15. A detector comprising an amplitude detector for measuring at selected points in time the amplitude of a musical signal, the amplitude detector being arranged to be connected to the rate of change means and the rate of change means being arranged to calculate the change in amplitude between the measurements and calculate the change between successive ones of said changes in amplitude, the rate of change means being arranged to compare the change of changes to threshold values and generate a signal signifying the onset of the musical gesture when the change of changes in amplitude exceeds said threshold values.

16. A detector as claimed in claim 15 comprising a disabling means for disabling the gesture detection process for a specified period equal to the smallest interval between gestures which can be realistically generated by a human performer.

17. A detector as claimed in claim 16 or 17 comprising a filter which is arranged to filter the musical signal and remove frequencies outside a selected frequency range.

18. A detector for determining the onset of a musical gesture comprising a pitch and amplitude detector for measuring at selected points in time the amplitude and pitch of a musical signal and having an output connected to a means for calculating the change in pitch and amplitude between the measurements and calculating the change between successive ones of said changes in the pitch and amplitude and comprising a comparator arranged to compare said change of changes to threshold values and to generate a signal signifying the onset of a musical gesture when the change of changes in pitch or amplitude exceeds the threshold values.

* * * * *